US005174391A

United States Patent [19]

Zijsling

[11] Patent Number: 5,174,391

[45] Date of Patent: Dec. 29, 1992

[54] TUBULAR ELEMENT FOR USE IN A ROTARY DRILLING ASSEMBLY AND METHOD

[75] Inventor: Djurre H. Zijsling, Rijswijk, Netherlands

[73] Assignee: Shell Oil Company, Houston, Tex.

[21] Appl. No.: 622,306

[22] Filed: Dec. 5, 1990

Related U.S. Application Data

[63] Continuation of Ser. No. 371,146, Jun. 26, 1989, abandoned, which is a continuation of Ser. No. 141,173, Jan. 6, 1988, Pat. No. 4,854,399.

[30] Foreign Application Priority Data

Apr. 16, 1987 [GB] United Kingdom ..... 8709229

[51] Int. Cl.[5] ..... E21B 7/04; E21B 17/22

[52] U.S. Cl. ..... 175/57; 175/61; 175/323; 175/325.1; 175/430; 175/431

[58] Field of Search ..... 175/325, 326, 323, 320, 175/410, 406, 61, 62, 325.1, 430, 431; 166/24

[56] References Cited

U.S. PATENT DOCUMENTS

| | | | |
|---|---|---|---|
| 1,848,128 | 3/1932 | Hinderliter | 175/406 X |
| 2,022,194 | 11/1935 | Galvin | 175/382 |
| 2,638,322 | 5/1953 | Condra | 175/406 X |
| 2,679,382 | 5/1954 | Schmidt | 175/401 |
| 2,911,195 | 11/1959 | Backer | 175/406 X |
| 3,194,331 | 7/1965 | Arnold | 175/323 |
| 3,237,705 | 3/1966 | Williams, Jr. | 175/406 |
| 3,268,274 | 8/1966 | Ortloff et al. | 175/325 |
| 3,338,069 | 8/1967 | Ortloff | 175/406 X |
| 3,575,247 | 4/1971 | Feenstra | 175/329 |
| 3,754,609 | 8/1973 | Garrett | 175/323 |
| 3,999,620 | 12/1976 | Watson | 175/403 |
| 4,465,147 | 8/1984 | Feenstra et al. | 175/73 |
| 4,485,879 | 12/1984 | Kamp et al. | 175/61 |
| 4,492,276 | 1/1985 | Kamp | 175/61 |
| 4,535,853 | 8/1985 | Ippolito et al. | 137/404 |
| 4,630,694 | 12/1986 | Walton et al. | 175/391 |

FOREIGN PATENT DOCUMENTS

| | | | |
|---|---|---|---|
| 85444 | 8/1983 | European Pat. Off. . | |
| 1239255 | 6/1986 | U.S.S.R. | 175/325 |
| 858513 | 1/1961 | United Kingdom . | |

*Primary Examiner*—Stephen J. Novosad

[57] ABSTRACT

A tubular drill string element, such as a stabilizer or tool joint, comprises an outer surface having in circumferential direction a ratchetted profile. The ratched profile is preferably oriented such that provides low resistance against right hand rotation but high resistance against left hand rotation of the drill string.

19 Claims, 3 Drawing Sheets

TUBULAR ELEMENT FOR USE IN A ROTARY DRILLING ASSEMBLY AND METHOD

This is a continuation of application Ser. No. 371,146, filed Jun. 26, 1989, now abandoned, which is a continuation of application Ser. No. 141,173, filed Jan. 6, 1988, now U.S. Pat. No. 4,854,399.

BACKGROUND OF THE INVENTION

The invention relates to a tubular element for use in a rotary drilling assembly.

Rotary drilling assemblies used in underground well drilling operations generally comprise a drill bit connected at the lower end of an elongate drill string. The drilling assembly may comprise a downhole drilling motor which drives the bit while the drill string above the motor is not rotated or rotated slowly by the rotary table at the surface.

As disclosed in European patent specifications No. 85444 and 109699, which correspond to U.S. Pat. Nos. 4,465,147 and 4,492,276, respectively, it may be desired that the drill string is not rotated during at least part of the drilling operations so as to maintain the tool face of the bit in a predetermined tilted orientation in the borehole in order to drill a deviated hole section. A difficulty encountered during such oriented drilling operations is that weight on bit fluctuations generate reactive torque fluctuations as a result of which the amount of twist in the elongated drill string varies and the orientation of the tool face becomes unstable. This unstable tool face orientation makes the steering process less effective and difficult to control. Thus there is a need for a drilling assembly which can be prevented from making swinging motions in the borehole as a result of reactive torque fluctuations.

SUMMARY OF THE INVENTION

The invention as claimed is intended to provide a tubular element which can be mounted in a rotary drilling assembly and which is able to suppress swinging motions of a drill string in response to such reactive torque fluctuations.

The tubular element according to the invention thereto comprises an outer surface which faces the borehole wall during drilling, which surface has a ratchetted profile in a plane cross-axial to a longitudinal axis of the element.

In a preferred embodiment of the invention said ratchetted profile is oriented such that it provides a high resistance against left hand rotation and low resistance against right hand rotation of the element about the longitudinal axis. In this manner during right hand rotation of the drill string, which is the normal rotation for most available drilling assemblies, only low friction forces are generated if the ratchetted surface slides along the borehole wall. However, if the rotary table is held stationary and the drill string tends to swing back due to reactive torque fluctuations, the sharp leading edge of the ratchetted profile penetrates into the borehole wall and generates resistance against any further left hand rotation.

The ratchetted profile may be mounted on any drill string tubular which faces the borehole wall during drilling, such as a stabilizer, tool joint, drill collar or housing of a downhole drilling motor. The ratchetted profile may further be created by forming a sharp edge at one side of the blades of a bladed stabilizer, by mounting toothed inserts on said stabilizer blades or by forming longitudinal saw-tooth shaped ridges on the outer surface of a tool joint.

BRIEF DESCRIPTION OF THE DRAWINGS

The invention will now be explained in more detail with reference to the accompanying drawings, in which.

DETAILED DESCRIPTION OF THE PREFERRED EMBODIMENTS

Figure 1A:
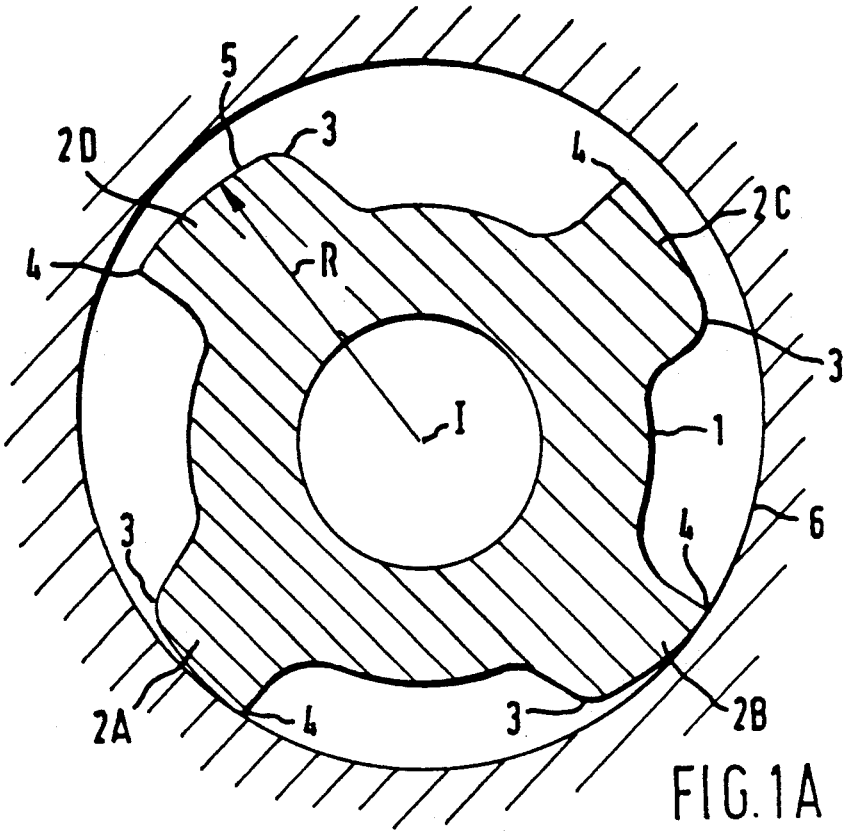
FIG. 1A illustrates a cross-sectional view of a stabilizer embodying the invention.

FIG. 1A shows a drill string stabilizer 1 comprising four helical or straight stabilizer blades 2A–D. Each of blades 2A–D has a rounded leading edge 3 and a sharp following edge 4. The outer surface 5 of each blade is located at a radius R from the longitudinal axis I of the stabilizer, which radius increases continuously, in a direction from said leading edge 3 towards said following edge 4. In the situation shown, the stabilizer lies on the low side of the borehole wall 6 so that the stabilizer blades 2A and 2B are in contact with the borehole wall 6 whereas there is some clearance between the other two stabilizers 2C and 2D and the borehole wall 6.

Figure 1B:
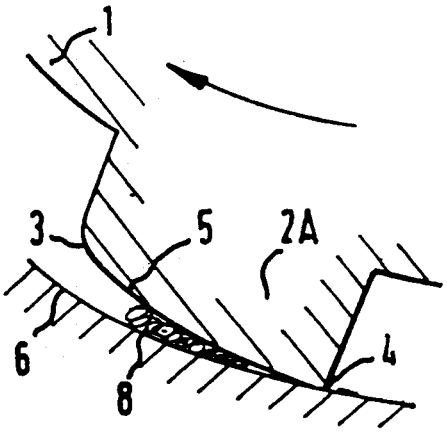
FIG. 1B illustrates a cross-sectional view of the toothed blades of the stabilizer of FIG. 1A acting against the low resistance encountered during right hand rotation.

FIG. 1B shows the movement of stabilizer blade 2A during right hand rotation of the stabilizer. During drilling operations right hand rotation is the usual direction of rotation of the drill string. As can be seen in FIG. 1B, during such right hand rotation the rounded edge 3 of the stabilizer blade 2A is the leading edge. The rounded edge 3 has poor cutting characteristics because of the extremely large negative back rake angle and thus prevents the blade 2A from penetrating into the borehole wall 6. In addition, accumulation of filter cake 8 between the outer surface 5 of the blade 2A and the borehole wall provides lubrication which assists in a low friction resistance of the blade against right hand rotation.

Figure 1C:
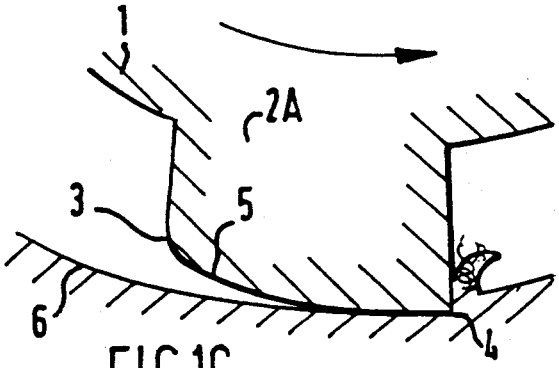
FIG. 1C illustrates a cross-sectional view of the toothed blades of the stabilizer of FIG. 1A acting against the high resistance encountered during left hand rotation.

As can be seen in FIG. 1C left hand rotation of the stabilizer causes the sharp edge 4 of the stabilizer blade 2A to penetrate into the borehole wall 6 and to build up resistance against further left hand rotation. In this manner variations of reactive torque exerted by the bit to a downhole motor above the bit when the rotary table is held stationary will not cause the drill string to swing back since such torque variations are transferred to the borehole wall via the stabilizer blades.

The ratchetted profile configuration according to the invention can be implemented in stabilizers with longitudinal stabilizer blades. In that case, the stabilizer blades will carve longitudinal grooves in the borehole wall under lateral pressure while the string is lowered through the borehole, thereby creating resistance against left hand rotation without changing the angular orientation of the drill string.

As illustrated in FIGS. 2A–2D, the ratchetted profile configuration according to the invention may also be implemented in helical stabilizers.

Figure 2A:
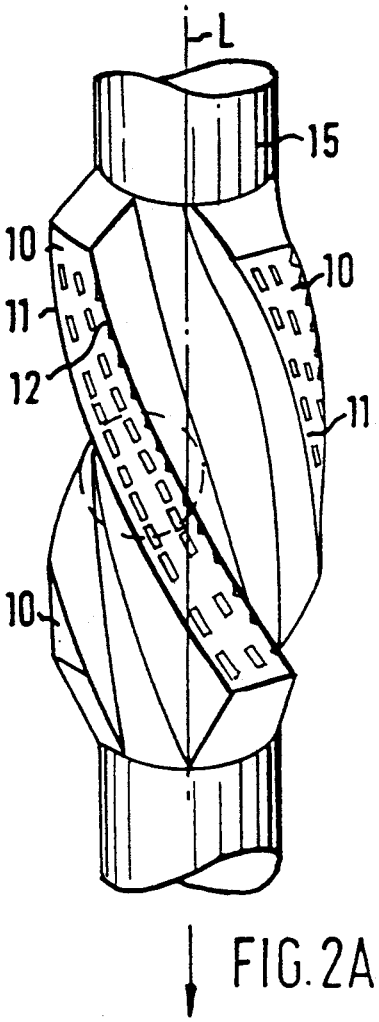
FIG. 2A illustrates a perspective view of a stabilizer comprising helical blades on which toothed inserts are mounted.
Figure 2B:
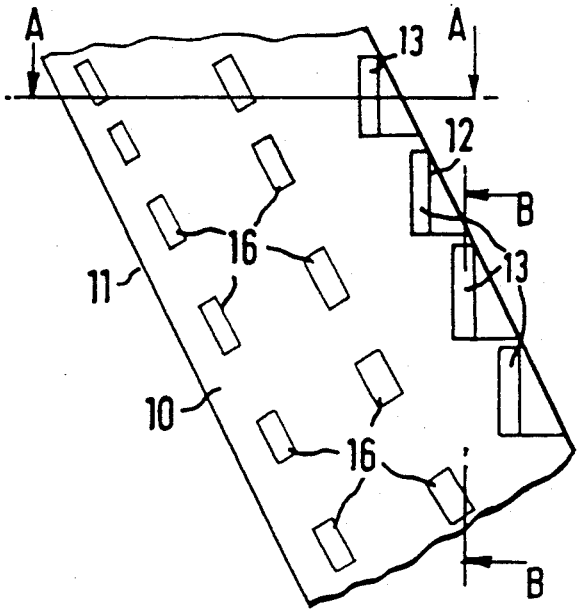
FIG. 2B illustrates the encircled portion of one of the blades of the stabilizer shown in FIG. 2A.
Figure 2C:
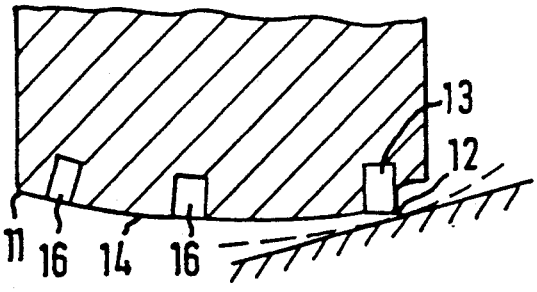
FIG. 2C illustrates a cross-section of the stabilizer blade of FIG. 2B taken along line A—and seen in the direction of the arrows.
Figure 2D:
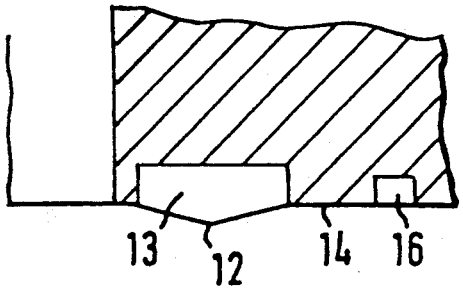
FIG. 2D illustrates a longitudinal section of the stabilizer blade of FIG. 2B taken along line B—B and seen in the direction of the arrows.

As can be seen in FIGS. 2B and 2C, each stabilizer blade 10 has a smooth leading edge 11 and a sharp following edge 12 formed by toothed inserts 13. The outer surface 14 of each stabilizer is located at a varying distance from the longitudinal axis L of the drill string 15, which distance increases in a direction from the leading edge 11 towards the following edge 12.

The outer surface 14 of each stabilizer blade 10 comprises a series of wear resistant tungsten carbide inserts 16 that are flush to said surface 14. Each blade 10 further comprises toothed inserts 13 which have in circumferential direction (see FIG. 2C) a saw-tooth profile and in longitudinal direction (see FIG. 2D) protrudes from the outer surface in an elongate triangular shape. The orientation of the toothed inserts 13 is such that the cutting edge 12 has a longitudinal orientation thereby enabling said cutting edges 12 to carve longitudinal grooves in the borehole wall while the string 15 is lowered through the borehole and to create resistance against left hand rotation without changing the angular orientation of the drill string 15.

The tooth inserts 13 provide low resistance against right hand rotation but high resistance against left hand rotation of the drill string 15.

Figure 3B:
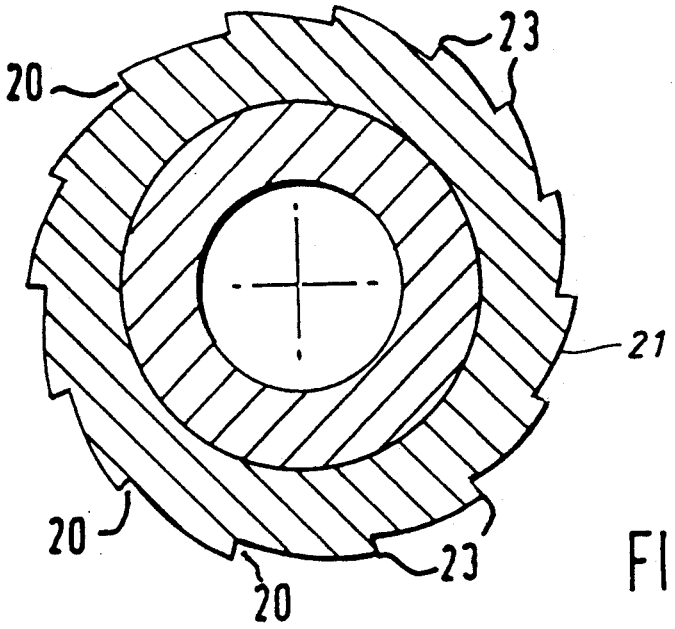
FIG. 3B illustrates a cross-section of the tool joint of FIG. 3A taken along line C—C and seen in the direction of the arrows.
Figure 3A:
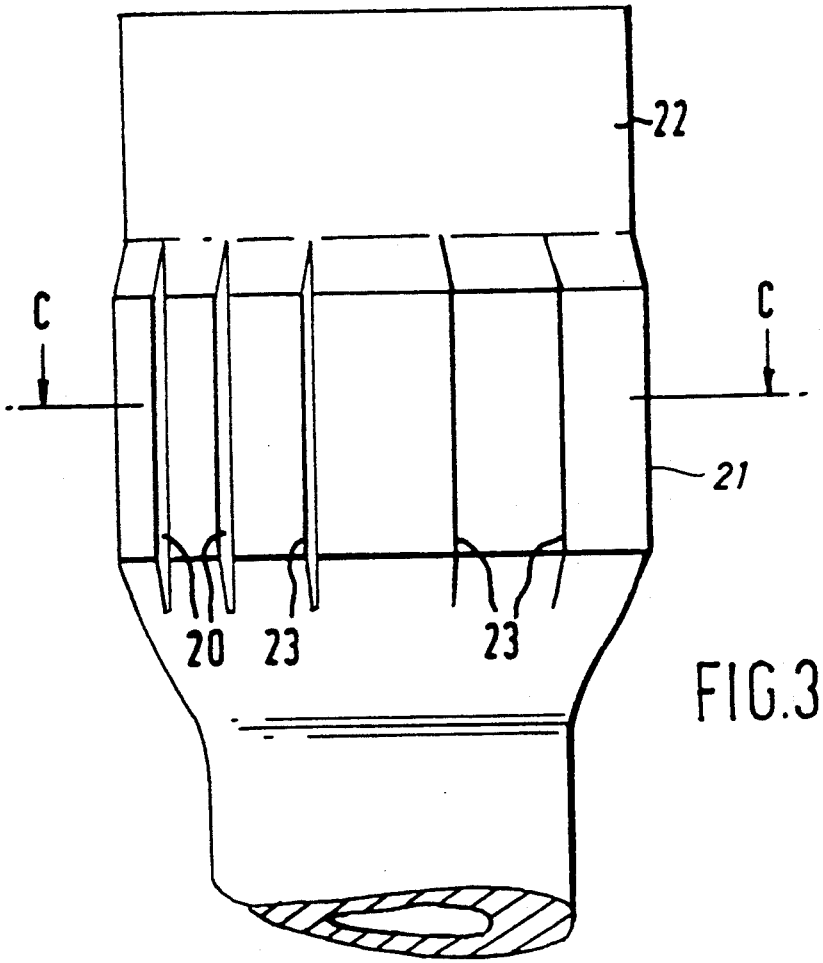
FIG. 3A illustrates a side elevational view of a tool joint embodying the invention.

FIGS. 3A and 3B show an embodiment of the present invention wherein a ratchetted profile is created by carving longitudinal grooves 20 in the essentially cylindrical outer surface 21 of a tool joint of a heavy weight drill pipe section 22. The ratchetted profile thus created comprises circumferentially distributed cutting edges 23 which provide low resistance against right hand rotation of the section 22 but high resistance against left hand rotation of the section 22. The high resistance against left hand rotation provided by the ratchetted profile according to the invention is of particular importance in combination with the continuous bit steering concept using mud motors in deviated wells as disclosed in European patent specifications No. 85444 and 109699.

During drilling in the oriented drilling mode with these continuous steering concepts, which requires that the drill string does not rotate, utilization of stabilizers or tool joints with the ratchetted profile according to the invention ensures that reactive torque fluctuations generated by weight-on-bit fluctuations are transferred to the borehole wall and do not induce variations in drill string twist. It will be understood that the average torque level in the drill string is transmitted to the surface and can be balanced by the rotary table.

It will further be understood that instead of providing stabilizers or tool joints with a ratchetted profile any other tubular drill string element which faces the borehole wall during drilling may also incorporate the ratchetted profile according to the invention.

Many other modifications may be made in the construction of the assembly hereinbefore described without departing from the scope of the appended claims. Accordingly, it should be clearly understood that the embodiments of the invention shown in the accompanying drawings are illustrative only.

What is claimed is:

1. A selectively rotatable tubular element for use in a rotary drilling assembly, the element comprising an outer surface which faces the borehole wall during drilling, said surface having a ratchetted profile in a plane cross-axial to a longitudinal axis of the element, said ratchetted profile presenting a leading edge and a following edge in relation to the normal rotation of the tubular element in which the leading edge is substantially smooth, and gradually and continuously increases in distance from said longitudinal axis from said leading edge to said following edge.

2. The element of claim 1, wherein said ratchetted profile is formed by blades of a bladed drill string stabilizer, which blades comprise each the smooth leading edge and the sharp following edge.

3. The element of claim 2, wherein said blades have a radius which gradually increases in a direction from said leading edge to said following edge.

4. The element of claim 1, wherein said ratchetted profile is formed by inserts which are circumferentially distributed over said surface and which have in circumferential direction a toothed shape.

5. The element of claim 4, wherein each insert forms in longitudinal direction an elongate triangular shaped protrusion.

6. The element of claim 4, wherein each insert is mounted on a blade of a bladed stabilizer near a following edge thereof.

7. The element of claim 1, wherein the tubular element is formed by a tool joint of a drill string section.

8. The element of claim 7, wherein the ratchetted profile is formed by longitudinal saw-tooth shaped grooves in the outer surface of the tool joint.

9. The element of claim 1, wherein said ratchetted profile is oriented such that it provides high resistance against left hand rotation and low resistance against right hand rotation of the element about the longitudinal axis as such rotations are viewed from the surface.

10. A tubular element for use in a rotary drilling assembly within a borehole, the element comprising:

an outer surface which faces the borehole wall during drilling, said surface having a ratchetted profile in a plane cross-axial to a longitudinal axis of the tubular element, said ratchetted profile presenting a leading edge and a following edge in relation to the normal rotation of the tubular element in which the leading edge is substantially smooth, and gradually and continuously increases in distance from said longitudinal axis from said leading edge to said following edge.

11. A tubular element in accordance with claim 10, wherein the tubular element is a drill string stabilizer and said ratchetted profile is formed by blades of the drill string stabilizer, said blades each comprising:

the smooth leading edge; and the sharp following edge.

12. A tubular element in accordance with claim 11, wherein said blades have a radius which gradually increases in a direction from said smooth leading edge to said sharp following edge.

13. A tubular element in accordance with claim 10, wherein said ratchetted profile is formed by a plurality of inserts which are circumferentially distributed over said surface and which have a toothed shape in circumferential direction.

14. A tubular element in accordance with claim 13, wherein each insert forms in longitudinal direction an elongate triangular shaped protrusion.

15. A tubular element in accordance with claim 13, wherein each insert is mounted on a blade of a bladed stabilizer near a following edge thereof.

16. A tubular element in accordance with claim 10, wherein the tubular element is formed by a tool joint of a drill string section.

17. A tubular element in accordance with claim 16, wherein the ratchetted profile is formed by a plurality of longitudinal saw-tooth shaped grooves in the outer surface of a tool joint.

18. A tubular element in accordance with claim 10, wherein said ratchetted profile is oriented such that it provides high resistance against left hand rotation and low resistance against right hand rotation of the element about the longitudinal axis as viewed from the upstream end of the drill string.

19. A method for protecting a drill string in a borehole from back swing in response to fluctuations of reactive torque produced during drilling with a downhole motor, said method comprising providing a selectively rotatable tubular element in the lower portion of the drill string such that an outer surface thereof presents a ratchetted profile to the borehole wall with a smooth leading edge and a sharp following edge with respect to the driving rotation of the drill string.

* * * * *